United States Patent [19]

Lee et al.

[11] 4,113,406

[45] Sep. 12, 1978

[54] COOLING SYSTEM FOR A GAS TURBINE ENGINE

[75] Inventors: Richard M. Lee, Upper Providence; Li C. Szema, Nether Providence, both of Pa.

[73] Assignee: Westinghouse Electric Corp., Pittsburgh, Pa.

[21] Appl. No.: 742,739

[22] Filed: Nov. 17, 1976

[51] Int. Cl.[2] ..... F01D 5/08

[52] U.S. Cl. ..... 415/115; 415/144; 415/170 R; 416/95

[58] Field of Search ..... 415/115, 116, 144, 145, 415/170 B, 170 R, 117; 277/3, 15, 53; 416/95

[56] References Cited

U.S. PATENT DOCUMENTS

| | | | |
|---|---|---|---|
| 2,741,455 | 4/1956 | Hunter | 415/115 X |
| 3,602,605 | 8/1971 | Lee | 415/175 X |
| 3,814,539 | 6/1974 | Klompas | 415/115 X |
| 3,945,758 | 3/1976 | Lee | 415/144 |

*Primary Examiner*—Carlton R. Croyle
*Assistant Examiner*—Donald S. Holland
*Attorney, Agent, or Firm*—F. A. Winans

[57] ABSTRACT

A gas turbine engine having cooled rotor blades is shown wherein the coolant is delivered to a stationary chamber adjacent the blades. A portion of the coolant is directed to seals between the stationary structure and the rotor and another portion is directed between adjacent rotor discs for entry through the downstream disc into the blades supported therein. The portion flowing through the seals is prevented from flowing into the fluid directed to the discs. Also, the coolant to the discs is given a velocity vector substantially equal to the velocity vector of the openings through the disc to the blade root to minimize pumping losses and temperature increases in the coolant during its delivery to the blade.

6 Claims, 3 Drawing Figures

COOLING SYSTEM FOR A GAS TURBINE ENGINE

BACKGROUND OF THE INVENTION

1. Field of the Invention

This invention relates to a system for cooling the hot parts of a gas turbine engine and more particularly to structure of the gas turbine engine defining a fluid flow path for delivering a coolant through the stator blades to an inner chamber for distribution into a main coolant flow directed to the rotor disc and blade roots and a secondary sealing fluid flow which is thereafter isolated from the coolant flow.

2. Description of the Prior Art

The invention generally provides a system for supplying cooling fluid such as air or steam to the rotor and root area of the rotor blade as shown in U.S. Pat. Nos. 3,602,605 and 3,647,311, both having a common assignee to the present invention. However, more particularly, the present invention is an improvement of the system disclosed in commonly assigned U.S. Pat. No. 3,945,758. In the last-mentioned patent, air, primarily used for cooling, is delivered through the stator vanes to an air box radially inwardly of the vanes. Thereupon, the air is divided: one portion flowing into an inner cavity between adjacent shoulders of adjacent rotor discs; another portion flows outwardly through a lip seal to prevent the hot motive fluid from flowing into the air box; and also a portion flowing through a series of seal rings disposed between the stator and the rotor. This last-mentioned flow is heated due to friction as it flows through the sealing structure, and is reintroduced into the cooling airflow just prior to the cooling flow entering the cavity between rotor discs for distribution to the blade root of the next downstream blade row. Such leakage of the sealing air raises the temperature of the cooling fluid and thereby decreases its cooling effectiveness.

SUMMARY OF THE PRESENT INVENTION

The present invention provides a cooling fluid delivery system with the second and succeeding turbine stages similar in most respects to the system abovedescribed except a sealing flow bypass or orifice is provided to route the portion of the fluid flow that flows across the seal points of the upstream seal structure to and through the seal points of the downstream seal structure of the same stage completely confined from the major portion of the fluid flow which is used for cooling. The cooling airflow is thus directed into the rotor cavity between adjacent discs free of contamination by the sealing air thereby eliminating the previous coolant heat up and providing a reliable coolant delivery system requiring substantially less coolant usage and hence an improvement in a gas turbine engine performance.

As a further improvement, the stationary orifice directing the coolant into the rotor cavity between adjacent discs is angled to provide a tangential swirling motion to the coolant having a speed and direction closely matched to the velocity of the rotor at the point of entry of the cooling air into the blade root area thereby minimizing entrance loss and effective temperature rise relative to the rotor.

DESCRIPTION OF THE PREFERRED EMBODIMENT

The cooling system of the present invention provides coolant fluid to the second and succeeding stages of a gas turbine engine in much the same manner as that shown in U.S. Pat. No. 3,945,758 and thus, to the extent the gas turbine apparatus needs to be understood, reference can be made to such patent. Further, it should be noted that although the above patent was described as incorporated in a Westinghouse Model 251 gas turbine and the instant application is described in a Westinghouse Model 501 gas turbine, the basic components, although of different configuration, are quite similar.

Figure 1:
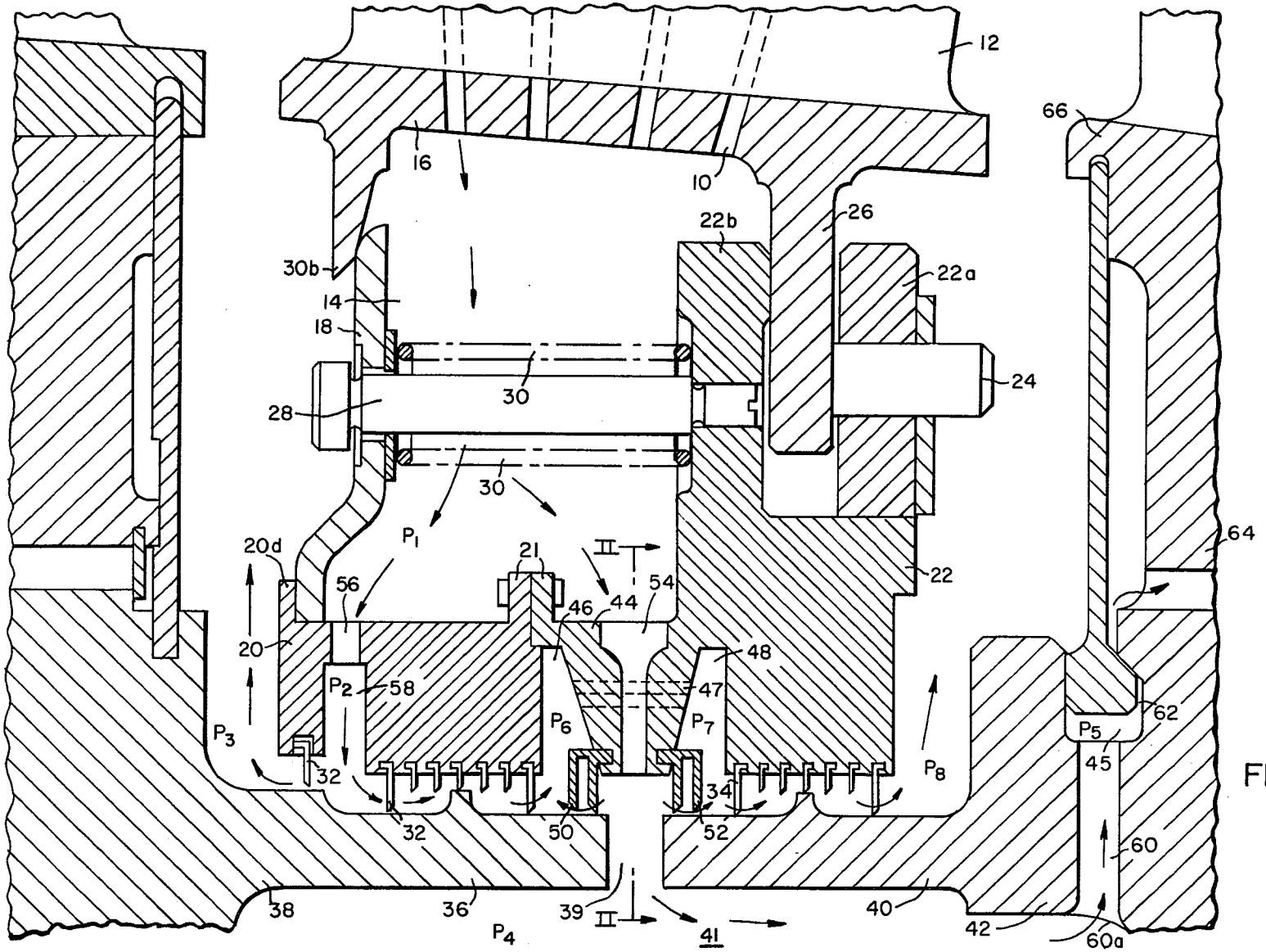
FIG. 1 is a sectional view of stator structure of a gas turbine engine bridging adjacent stages and showing the cooling airflow path of the present invention.

Thus, referring now to FIG. 1, cooling fluid such as compressed air is delivered through passages 10 in the stator vanes 12 into a radially inner air box 14 defined by the base 16 of the stator vanes, an upstream annular side plate 18, an upstream annular seal holder 20, and a downstream annular seal holder 22. As shown, the downstream annular seal holder 22 is supported by an annular row of pins 24 extending through a flange member 26 projecting radially inwardly from the base 16 and a radial slot in the downstream flange **22*a* of opposed radially outwardly projecting flanges 22*a* and 22*b* of the downstream seal holder 22. Such mounting permits radial growth of the seal holder as it becomes heated during running of the turbine. The upstream flange 22*b* supports a pin 28 extending in the upstream direction which in turn supports the upstream side plate 18. Spring means 30 bear against the side plate and flange 22*b* to seal the plate against the annular lever 30*b* on the base and also seal the flange 22*b* against flange 26**.

The upstream seal holder 20 is secured to the downstream seal holder 22 as through bolts (not shown) in adjacent upstanding lip portions 21. The upstream seal holder also provides an upstream radially extending shoulder **20*d* for receipt in sealing relationship, as urged by spring 30, with the radially inner portion of the side plate 18. Thus, the air box 14 for receiving the cooling fluid in a plenum-like chamber is defined by the stator vane base 16, side plate 18 and flange 22*b*, and the respective seal holders 20 and 22**.

As is seen, the seal holders 20 and 22 support, on their radially inwardly facing surface, a plurality of caulked-in seal rings 32, 34 with the seal rings 32 in the upstream seal holder 20 radially extending toward an axially extending shoulder 36 of an upstream rotor disc 38 defining sealing points therebetween. Likewise, the seal rings 34 extend toward an axially extending shoulder 40 of a downstream rotor disc 42 defining sealing points therebetween. The facing sealing structure of the seal ring and rotor disc shoulders generally define a labyrinthian seal.

Still referring to FIG. 1, the adjacent shoulders 36 and 40 of adjacent rotor discs 38 and 42 are separated by a relatively narrow-axial gap or space 39 that radially leads into a cavity 41 between the two discs. Further it is seen that the seal holders provide structure, namely an integral portion 44 of the downstream seal holder 22, which is axially spaced from those portions of both upstream and downstream seal holders supporting the seal rings and thus defining an upstream chamber 46 and a downstream chamber 48. Axially extending openings 47 extend through portion 44 to chamber 46 in fluid flow communication with chamber 48. Such openings 47 will hereinafter be referred to as seal leakage ducts.

As portion 44 is in alignment with and bridges the gap 39, it also supports sealing rings 50, 52 extending to adjacent the shoulders 36 and 40 respectively and thereby seal the cavity 41 from both chambers 46 and 48. A radially extending opening, as viewed in FIGS. 1 and 2 and hereinafter referred to as a preswirl nozzle 54, extends through the portion 44 to place the air box 14 in fluid flow communication with the cavity 41.

The upstream seal holder 20 also defines a radially extending opening 56 leading to an annular chamber 58 between adjacent seal rings 32 at the upstream end thereof. This opening 56 serves to distribute a metered amount of the cooling fluid in the air box 14 to flow through cooperating sealing structure to prevent the flow of the hot motive fluid of the main gas stream from flowing to the seals 32, 34 or into the air box 14 in a manner to be described.

Thus, exemplary pressures will be assigned to the various boxes, plenums and chambers in order to illustrate the cooling fluid flow of the present system. Such pressures should be considered only exemplary of the relative pressures to provide the direction of flow desired. Also, the cooling fluid is assumed to be airdelivered from a compressor so that, upon entering air box 14, the pressure is assumed to be at the necessary pressure designated $P_1$. Opening 56 is sized so as to provide a pressure designated $P_2$ in chamber 58 with $P_2$ less than $P_1$ but slightly greater than the pressure $P_3$ present at the upstream end of the most upstream seal ring. Thus, there is limited outflow of the cooling fluid through the sealing point to prevent the working fluid from flowing into chamber 58. This portion of the cooling fluid thus perfects the sealing relationship and subsequently flows into the main gas stream via a vortex motion.

The pressure $P_4$ within the cavity 41 is considerably less than the pressure $P_2$ within the air box (i.e. such as for instance 10 psi); thus, the majority of the cooling fluid flows from the air box through the preswirl nozzle 54, through the gap 39, and into the cavity 41.

A disc hole 60 in the downstream rotor disc 42 leads from the cavity 41 to a chamber 62 subadjacent and in flow communication with the root area 64 of the rotor blade 66. The pressure $P_5$ in chamber 62 is somewhat less than the pressure $P_4$ so that the cooling fluid is delivered to the root of the blade 66 and from there, flows through cooling passages in the blade (not shown) and into the main gas stream.

It is also seen that a portion of the cooling fluid in chamber 58 at pressure $P_2$ flows downstream across seal points of seal rings 32 to chamber 46 which has a pressure $P_6$ somewhat less than pressure $P_2$. The fluid from this chamber then flows through leakage duct 47 into chamber 48 maintained at pressure $P_7$ which in turn is less than pressure $P_6$, and thence across the seal points associated with seal rings 34 to exit the labyrinthian seal at a pressure $P_8$ which is the lowest pressure in this system yet greater than the pressure of the gas stream at the end of vane 10. From here the coolant flows outwardly and into the main gas stream at the downstream end of the stator vanes. Thus, this portion of the cooling fluid also perfects the seal to prevent the working fluid from entering the seals.

It is seen that the chambers 46 and 48 on either side of portion 44 are at a lesser pressure than the cavity 41 thereby preventing any cooling fluid flow that has passed through the sealing structure, and become heated thereby, from flowing into the main cooling fluid flow path or contaminating the cooling fluid in the cavity. The seals 50 and 52 although permit limited leakage out of the main cooling fluid flow path and into the sealing fluid flow path, yet the pressure differentials thereacross are kept small, to prevent any significant loss of cooling fluid.

Thus, it is seen, two separate flow paths are provided, one for maintaining positive flow across the sealing structure to prevent the working or motive fluid from contacting the seals, and a second providing a main source of cooling fluid for delivery to the rotor disc and downstream rotor blades for cooling. And, although there can be limited leakage of the cooling fluid into the sealing fluid, there is no contamination or intermingling of the sealing fluid into the main cooling fluid flow. This maintains the cooling fluid at essentially the temperature of that in the air box and thereby requires less coolant flow to obtain the desired cooling of the rotor disc blade and blade root.

Figure 2:
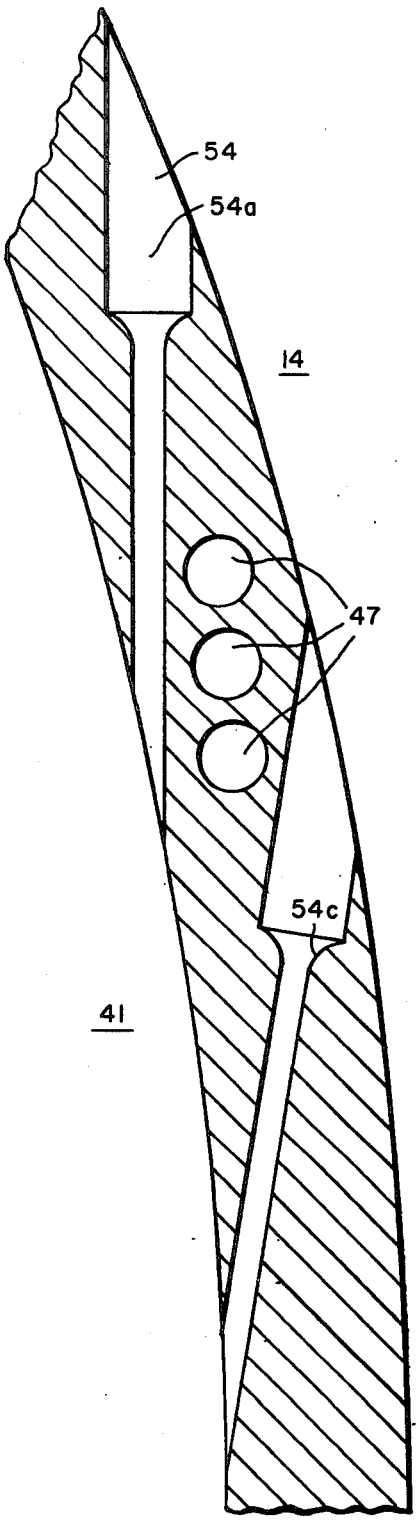
FIG. 2 is a view generally along lines II—II of FIG. 1 showing the construction details in one pitch along the circumference; and, FIG. 3 is a schematic view of the circumferential nozzle arrangement.

Referring now to FIG. 2, it is seen that the preswirl nozzle 54 does not extend through the stationary seal holder 44 in a radial direction but is directed in a generally circumferential direction from the radially outer face (i.e. adjacent the air box) to the radially inner face (i.e. adjacent the gap 39) in the direction of rotation of the rotor.

In delivering coolant from a stationary structure to a rotating system, two important factors must be considered; namely: (1) the coolant temperature rise; and, (2) the entrance pressure loss. Both of these should be minimized.

Therefore, ideally, the velocity of the cooling fluid entering the cavity 41 and the direction of its entry should be such that the relative velocity between the entry **60*a* to the disc hole 60 through which the cooling fluid must flow and the cooling fluid is zero. In such case, with respect to the rotor, the total temperature of the coolant is the same as the static temperature thereof at the nozzle discharge. Further, the pressure drop between the nozzle 54 and the entrance of the disc hole is a minimum. To accomplish this, the entry angle for the cooling fluid must be tangential to the circular path defined by the rotating opening of the disc and the velocity of the cooling fluid must be equal to the velocity of the rotating opening. Any discrepancy between the tangential direction and the direction of the fluid and the velocity of the disc at the opening 60*a*** and the velocity of the cooling fluid results in raising the total temperature of the cooling fluid on the basis that the total temperature of the coolant is equal to the static temperature plus the temperature equivalent of the relative velocity.

Such rise in temperature of the cooling fluid reduces the cooling effectiveness and such increase in entrance loss reduces the flow coefficient. Thus, it is preferable to minimize the relative motion between the fluid and the rotor.

In that it is the disc hole 60 into which the coolant must flow, it is desirable for the above reasons to match the coolant flow direction and velocity to the velocity vector of the rotating inlet 60a of the hole 60.

Figure 3:
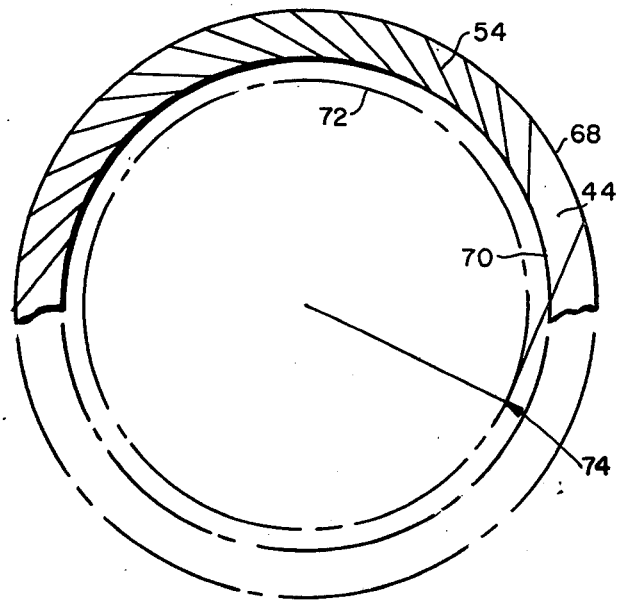

Reference is made to FIG. 3 to illustrate the angular orientation of the preswirl nozzle 54. The outer circle 68 represents the regularly outermost surface of portion 44 of the downstream seal holder 22 and the intermediate circle 70 represents the radially inner surface of the same part so that between them is defined the radial thickness of portion 44. The innermost circle 72 represents the circle described by the inlet 60a as the rotor 42 rotates. It is seen that the preswirl nozzle is angled through the portion 44 so as to tangentially intercept the inner circle 72, as at 74. Thus, the direction imparted to the coolant by the angular disposition of the preswirl nozzle 54 is such that it has no radial component with respect to the opening 60a in the disc through which it must flow and thus no work or temperature increase is imparted to the coolant to change its direction of flow. The flow of the coolant through disc hole 60 is aided by its centrifugal motion as well as by the lower pressure $P_5$ at the next blade root.

The shape or configuration of the preswirl nozzle 54 is similar to a standard convergent nozzle tangentially oriented. The rounded entrance is provided to minimize pressure losses therethrough yet accelerate the fluid to a velocity equal to the velocity of the rotor at the inlet 60a to the disc hole 60. Thus, referring to FIG. 2, the nozzle area is decreased from an initial opening 54a to a smaller smooth wall restrictive accelerating portion 54c. Therefore, with both coolant flow velocity vector matching the velocity and direction of the inlet 60a to the rotor disc hole 60, minimal heat is added to the coolant and the total temperature remains relatively constant except for the heat the cooling air accumulates in accomplishing its primary function of cooling the rotor disc and rotor blade roots.

Thus, a coolant delivery system is provided which maintains the coolant fluid free of any contamination by a controlled portion of the fluid flowing through adjacent sealing means providing a sealing flow passage completely separate and at lower pressures than the main coolant flow passageways. Further, the total temperature of the coolant is kept to a minimum to minimize any increase in temperature caused by directional and velocity changes to the fluid as it flows to that portion of the rotor which is to be cooled. Also, the coolant entrance loss to the disc hole of the next adjacent blade is minimized.

What is claimed is:

1. In a gas turbine engine having:

a pair of axially adjacent rotor disc means for rotatably supporting rotor blades in the motive gas path, said disc means defining therebetween a relatively narrow axial space leading radially inwardly to a rotor cavity between said adjacent disc means;

stator means including a stationary stator vane disposed in the motive gas path between adjacent rotor blades, sealing means supported at the radially inner end of said vane and bridging said narrow axial space, said sealing means defining an axial series of seal points along each disc means; and, coolant delivery means for supplying coolant fluid to both said sealing means and said disc cavity, said delivery means comprising:

a stationary chamber generally adjacent said rotor discs and having inlet means for receiving said coolant fluid at a pressure greater than the pressure of the motive gas at the seal points of the upstream disc of said axially adjacent discs, and having a first outlet means providing fluid flow communication between said chamber and said series of sealing points along said upstream disc, and a second outlet means in alignment with said narrow axial space to discharge coolant fluid therethrough and into said cavity;

means defining a substantially confined flow path for fluid flow communication from between said seal points of said upstream disc to between the seal points along the adjacent downstream disc; and wherein, the two outlets of said chamber are sized such that the relative pressure of the fluid is greater at the discharge of said second outlet than between said seal points whereby coolant will not flow into said cavity from between said sealing means.

2. Structure according to claim 1 further including an opening in said downstream disc for fluid communication therethrough between said cavity and the rotor blade mounted thereon and wherein said second outlet means is in the form of a converging nozzle and disposed at an angle generally tangential to the circle described by said rotating disc opening whereby the coolant fluid is delivered from said stationary chamber to said rotating cavity at a velocity vector substantially equal to the velocity vector of said opening to minimize the pressure losses and total temperature increase in said fluid in supplying coolant to said rotor blade.

3. Structure according to claim 1, wherein said second outlet is generally sealed from said confined flow path by said sealing means to minimize coolant entry into said confined flow path from second outlet.

4. An improved cooling system for a gas turbine engine having axially adjacent upstream and downstream rotor discs defining axially extending spaced-apart shoulder means providing a gap leading to a radially inner rotor cavity therebetween;

stator means including means for supporting stationary sealing means adjacent said shoulders and bridging the axial gap; and, coolant delivery means for supplying coolant fluid to both said sealing means and said disc cavity comprising a stationary chamber generally adjacent said rotor discs and having inlet means for receiving coolant fluid and a first outlet means providing coolant flow communication between said chamber and the sealing means associated with said upstream disc and a second outlet means in general axial alignment with said gap for flow communication between said chamber and said cavity, wherein the improvement comprises:

an axially extending flow path providing confined coolant flow communication from between said sealing means adjacent said upstream disc to between sealing means adjacent said downstream disc; and, said two outlets are sized such that the relative pressure of the coolant fluid is greater at the discharge of said second outlet than between said sealing means adjacent either said upstream or downstream disc whereby coolant will not flow into said cavity from between said sealing means.

5. Structure according to claim 4 further including an opening in said downstream disc for coolant fluid flow communication between said cavity and the rotor blade and having a further improvement comprising:

said second outlet defining a nozzle disposed at an angle generally tangential to the circle described by said disc opening as said disc rotates to impart a velocity and direction to said discharged coolant fluid generally equal to the velocity and direction of said rotating opening to minimize the pressure losses and total temperature increase in said coolant fluid to enter said opening for cooling said blade.

6. Structure according to claim 4, wherein said second outlet is generally sealed from said confined flow path by said sealing means whereby minimal coolant enters said confined flow path from said higher pressure discharge of said second outlet.

* * * * *